US008464569B2

(12) United States Patent
Heimann et al.

(10) Patent No.: US 8,464,569 B2
(45) Date of Patent: Jun. 18, 2013

(54) INTERNAL ROLLER TOOL FOR BENDING A STRIP INTO A TUBE

(75) Inventors: Bernhard Heimann, Moers (DE); Johannes Kamps, Wegberg (DE)

(73) Assignee: SMS MEER GmbH, Moenchengladbach (DE)

( * ) Notice: Subject to any disclaimer, the term of this patent is extended or adjusted under 35 U.S.C. 154(b) by 839 days.

(21) Appl. No.: 11/821,803

(22) Filed: Jun. 26, 2007

(65) Prior Publication Data

US 2008/0072645 A1 Mar. 27, 2008

(30) Foreign Application Priority Data

Jun. 27, 2006 (DE) ..... 10 2006 029 491

(51) Int. Cl.
*B21D 5/08* (2006.01)
*B21D 39/02* (2006.01)
*B21D 51/28* (2006.01)

(52) U.S. Cl.
USPC ..... 72/176; 72/52

(58) Field of Classification Search
USPC ..... 72/48, 51, 52, 176, 178, 179, 181, 72/115, 120, 367.1, 368
See application file for complete search history.

(56) References Cited

U.S. PATENT DOCUMENTS

| | | | | |
|---|---|---|---|---|
| 3,472,053 | A * | 10/1969 | Chang | 72/178 |
| 3,776,010 | A | 12/1973 | Krakow | 72/12 |
| 4,770,019 | A * | 9/1988 | Kuramoto et al. | 72/181 |
| 5,245,849 | A | 9/1993 | Hume | 72/155 |
| 5,865,053 | A * | 2/1999 | Abbey et al. | 72/52 |
| 2003/0074943 | A1 * | 4/2003 | Zubcevic | 72/51 |

FOREIGN PATENT DOCUMENTS

| | | |
|---|---|---|
| JP | 56066323 | 6/1981 |
| JP | 04041021 | 2/1992 |

* cited by examiner

*Primary Examiner* — Teresa M Ekiert
(74) *Attorney, Agent, or Firm* — Andrew Wilford

(57) ABSTRACT

An internal tool for bending a strip passing in a strip-travel direction into a tube has a support juxtaposable with a face of the passing strip, at least two roller holders pivotal on the support about respective offset holder pivot axes generally parallel to the strip-travel direction, and respective rollers carried in the holders and rotatable about respective roller axes generally perpendicular to the respective holder axes.

12 Claims, 2 Drawing Sheets

⊗R

INTERNAL ROLLER TOOL FOR BENDING A STRIP INTO A TUBE

FIELD OF THE INVENTION

The present invention relates to the manufacture of tubing from strip. More particularly this invention concerns an internal roller tool for bending a strip into a tube.

BACKGROUND OF THE INVENTION

The invention relates to an internal shaping tool for deforming a metal sheet or strip into a pipe. The tool has at least two rollers that are pivotable about swivel axes and that start on one side of the metal sheet for shaping same.

In pipe manufacturing, according to one common technology first a flat metal strip, generally wound from a coil, is shaped into a tubular element and in a subsequent operation is welded at the joint that is formed on the edges of the strip. For the shaping of the metal strip into the tubular element, devices are known in practice that have the above-described internal shaping tools, typically acting with outer tools that engage the outer face of the strip to press its inner face against the internal tool.

The known internal shaping tools employ rollers that are either fixedly or rigidly provided in a defined position on a hearing element, or are each positioned in a pivotal holder.

The shape of the body to be manufactured depends on the final dimensions to be achieved, as well as the material properties of the metal strip, i.e. its tensile strength, yield point, and also its thickness. For the known internal shaping tool having fixed rollers, response to a change in characteristics for the pipe or shaped body to be shaped can be made only with great effort. In particular, a modification using a different or rebuilt internal shaping tool is necessary.

However, for the known rollers that are pivotal via their holders it is also not possible to achieve a desired configuration of the pipe geometry via adjustment of their angular positions. Namely, the pivot point is arbitrarily selected and has no relation to the shape to be produced, and thus also cannot be compensated for by the contoured shape of the rollers.

In practice, therefore, it has been shown that due to the inadequate adaptability of the internal shaping tool the rollers often do not bear on the workpiece over their full width, resulting these roller running on their edges. This results in surface damage to the metal strip being shaped.

OBJECTS OF THE INVENTION

It is therefore an object of the present invention to provide an improved internal roller tool for bending a strip into a tube.

Another object is the provision of such an improved internal roller tool for bending a strip into a tube that overcomes the above-given disadvantages, in particular that avoids the above-given disadvantages.

A particular objective is to easily, quickly, and thus economically ensure optimal full-width bearing of the rollers, even if the shape of the workpiece changes.

SUMMARY OF THE INVENTION

An internal tool for bending a strip passing in a strip-travel direction into a tube. The tool has according to the invention a support juxtaposable with a face of the passing strip, at least two roller holders pivotal on the support about respective offset holder pivot axes generally parallel to the strip-travel direction, and respective rollers carried in the holders and rotatable about respective roller axes generally perpendicular to the respective holder axes.

Since according to the invention the pivot axes are provided where the work is done, specifically, at the midpoint or in the vicinity of the midpoint of the rollers themselves, the rollers may be easily adapted or adjusted precisely to the shape desired, since the rollers are in the optimal position for shaping a specific metal strip. The rollers may thus be pivoted such that they always contact the metal strip along their full width, and edge bearing may be reliably avoided.

The two pivot axes are preferably symmetrically positioned with respect to a center plane of a common holder, and both rollers can be symmetrically pivoted.

According to one advantageous embodiment, means are provided for synchronizing the pivoting of the rollers that are pivotally positioned in or on the support. These means allow mirror-image pivoting of the rollers pivotally positioned in or on the holder, relative to the central piano of the holder. Thus they are pivoted synchronously toward and away from each other.

According to the invention, the means are formed by toothed sector gears that are respectively connected in a fixed manner to the roller holder and that mesh with one another. Furthermore, at least one extensible actuator is provided that engages between the support and the roller holder in order to pivot the roller holder together with the roller about the pivot axis. In one preferred embodiment, only a single extensible actuator is provided for this purpose.

In addition to the pivotal rollers, a nonpivoting center roller may be provided on the support or on an additional holder adjoining the holders of the side rollers. In this case, the nonpivoting center roller may be mounted on the support or on an additional holder in such a way that the center roller lies in the center plane of the support. The center roller may also be positioned so as to be adjustable in a direction lying in the center plane, for example in the vertical direction. In this case the adjustability may be achieved by means of a spacer. In one alternative, the adjustability is achieved by a threaded adjuster, a screw-nut element. Alternatively, an eccentric or a rocker may be provided for adjusting and setting the center roller.

By use of the proposed embodiment of an internal shaping tool, the position of the side rollers may be easily and economically adapted to the desired geometric proportions, thus providing an optimal start on the metal strip to be shaped. A response may thus be easily made to a change in the shape of the shaped body.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
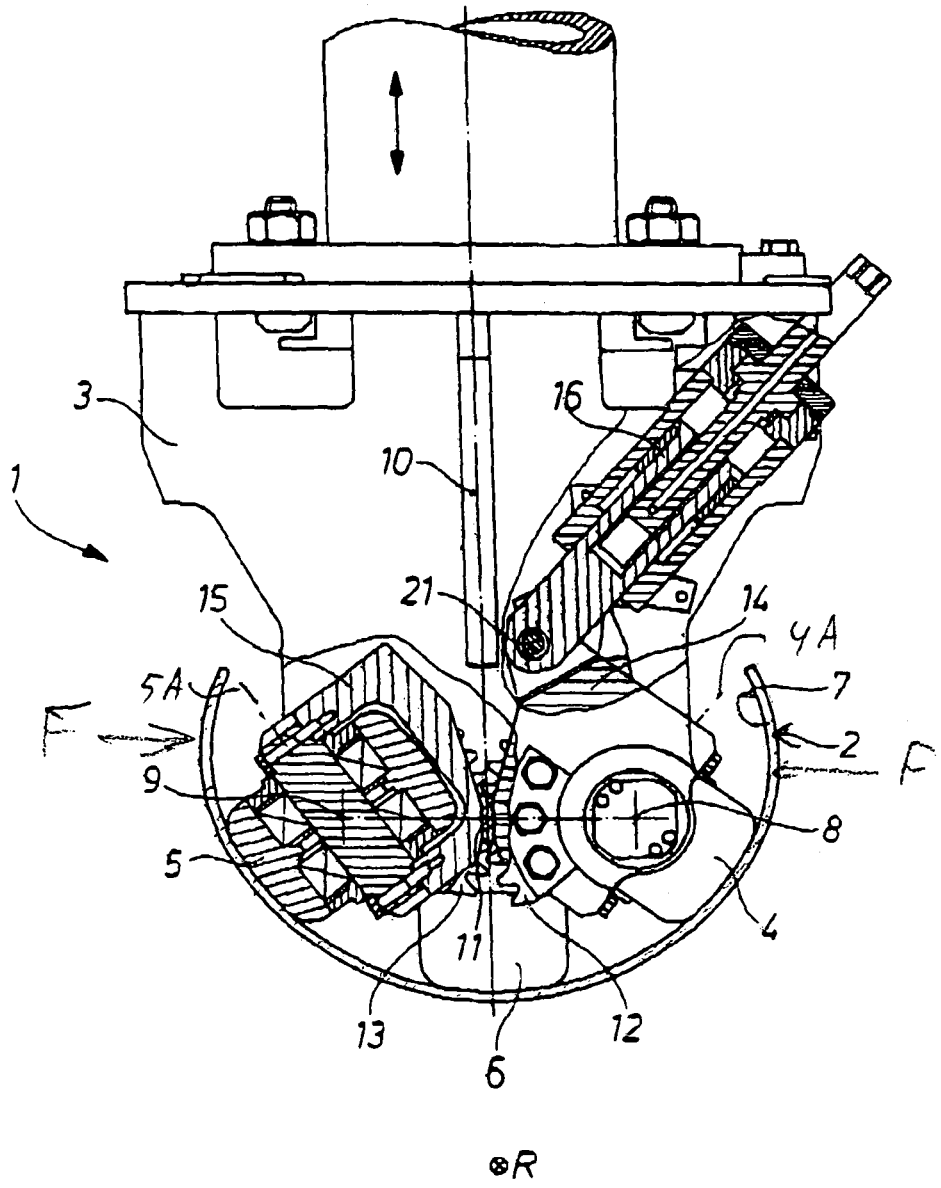
FIG. 1 is an end view largely in cross section through the system of this invention.

FIGS. 1 ₽ 3 show an internal shaping tool 1. The metal strip 2 to be shaped being shown only in FIG. 1. The metal strip 2 is displaced in a strip-travel direction R and is pressed inward against the tool 1 by unillustrated outer tools as illustrated schematically at 7 in FIG. 1.

To impart the desired shape to the metal strip 2, the internal shaping tool 1 has a support 3 on which in the present case a total of three rollers 4, 5, and 6, namely two side rollers 4 and 5 and a center roller 6, are mounted, pivotal about respective center axes 4A, 5A, and 6A. All three rollers 4, 5, and 6 contact one face 7 of the metal strip 2, here shown already bent into a U- or C-section. Not illustrated on the other side of the metal strip are starter rollers, that are provided on side roller beams in a known manner, and that exert the inward bending force F.

The two side rollers 4 and 5 are not rigidly mounted on the support 3, as is the center roller 6, but instead are pivotal about respective pivot axes 8 and 9 that extend perpendicularly through the axes 4A and 5A and parallel to the strip-travel direction R. As illustrated most clearly in FIG. 1, the two side rollers 4 and 5 are supported in respective roller holders 14 and 15 that pivot symmetrically with respect to a center plane 10 of the common support 3, the axes 8 and 9 symmetrically also flanking this plane 10. Means 11 are provided for synchronizing the pivoting of the side rollers 4 end 5. In the illustrated embodiment, according to one preferred embodiment these means 11 are composed of sector gears 12 and 13 fixed and even formed on the holders 14 and 15. The sector gear 12 and 13 are centered on the respective axes 8 and 9 and mesh with each other.

The means 11 for synchronization ensure symmetrical positioning of the rollers 4 and 5, thereby facilitating a stable shaping process. In particular, twisting of the shaped body, i.e. the metal strip 2 to be shaped, is prevented.

To enable the two side rollers 4 and 5 to be quickly and easily adjusted to a desired pivot angle, a single extensible actuator 16 is present that, for example, is designed as a screw-nut adjusting system. One end of the extensible actuator 16 connected at a pivot 20 to the support 3. The other end of the extensible actuator 16 is likewise connected at a pivot 21 to one of the two roller holders, here to roller holder 14. Actuation of the extensible actuator 16 results in a change in the distance between the pivots 20 and 21, causing the desired pivoting of the roller holder 14, and therefore the side roller 4, about the pivot axis 6. Engagement of the two toothed sector gears 12 and 13 causes this pivot motion to be simultaneously transmitted to the other roller holder 15, and thus to the other side roller 5, so that both side rollers 4 and 5 are symmetrically pivoted with respect to the center plane 10.

Figure 2:
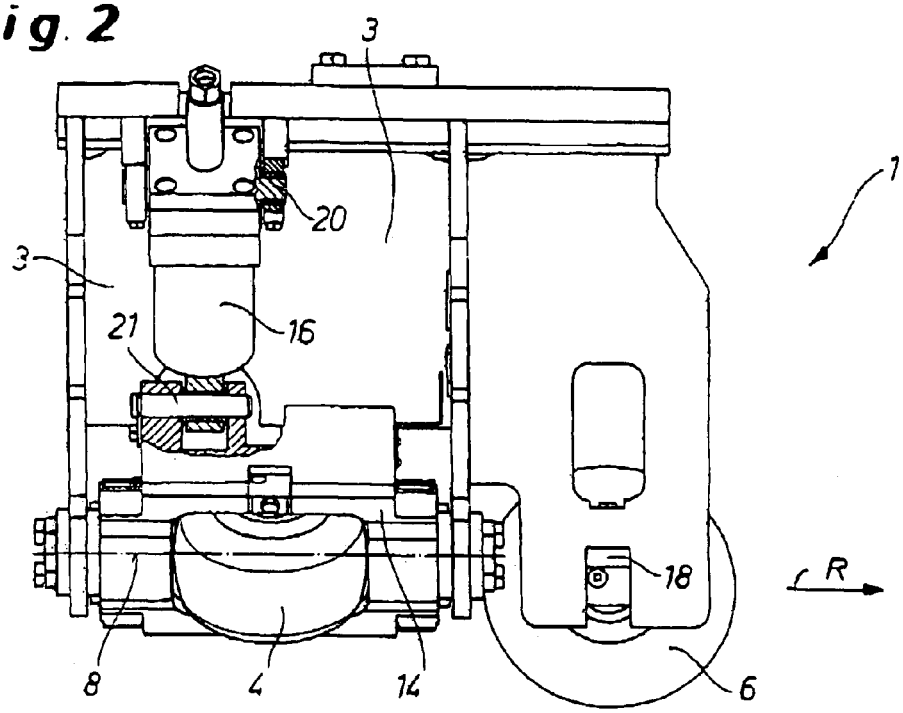
FIG. 2 is a side view partly in axial section through the system of FIG. 1.
Figure 3:
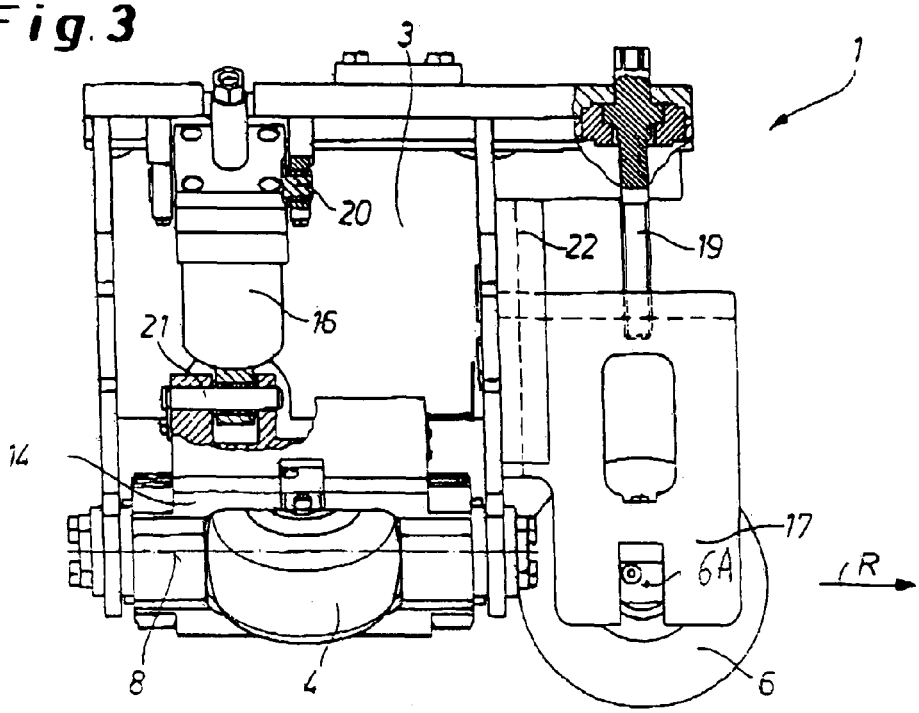
FIG. 3 is a view like FIG. 2 of a variation on the system of this invention.

The additional roller 6 designed as a center roller is bisected by the center plane 10 and the axis 6A is perpendicular to this plane 10, which here is parallel to the direction R. The roller 6 may be mounted directly on the support 3 or, as shown in FIGS. 2 and 3, may be mounted on a separate, holder 17. The holder 17 may be vertically shiftable on the support 3 by means or a vertical dovetail guide 22.

The center roller 6 is adjustable vertically perpendicular to the shaping direction R. In the case of the illustrated embodiment according to FIG. 2, the adjustment in this direction is made by an appropriately selected spacers 18. The approach according to FIG. 3 instead provides an adjusting element 19, designed as a screw-nut system, that easily allows the center roller 6 to be adjusted.

By use of the proposed embodiment of the internal shaping tool the rollers may be easily and quickly adapted to a change in the geometry of a shaped body, ensuring precise adjustment to the geometric requirements of the shaped body.

Depending on the application, it is also possible to set only a starting position with the pivot adjustment. The rollers then have a certain degree of freedom for optimal free adjustment, that is achievable in particular by gearing as a transmission means that produces a symmetrical adjustment. In other words the rollers 4 and 5 are set at a certain position to begin the tube-forming operation, but once it has started they are allowed to pivot freely, the sector gears 12 and 13 ensuring that they move synchronously.

We claim:

1. An internal tool for bending a strip passing in a strip-travel direction into a tube, the tool comprising:

a support juxtaposable with a face of the passing strip;

at least two roller holders pivotal on the support about respective offset holder pivot axes generally parallel to the strip-travel direction;

respective side rollers carried in the holders and rotatable about respective roller axes generally perpendicular to the respective holder axes and each perpendicularly intersecting the respective holder pivot axis, the holder pivot axes extending through the rollers generally at the respective roller axes; and a middle roller generally lying on the plane and rotatable about an axis generally perpendicular to the plane.

2. The strip-bending tool defined in claim 1 wherein the holder pivot axes are substantially parallel to the strip-travel direction.

3. An internal tool for bending a strip passing in a strip-travel direction into a tube, the tool comprising:

a support juxtaposable with a face of the passing strip;

at least two roller holders pivotal on the support about respective offset holder pivot axes generally parallel to the strip-travel direction;

respective side rollers carried in the holders and rotatable about respective roller axes generally perpendicular to the respective holder axes, the holder pivot axes extending through the rollers generally at the respective roller axes;

a middle roller generally lying on the plane and rotatable about an axis generally perpendicular to the plane; and means coupling the holders together for synchronous movement about the respective pivot axes.

4. The strip-bending tool defined in claim 3 wherein each of the roller axes perpendicularly intersects the respective holder pivot axis.

5. The strip-bending tool defined in claim 3 wherein the means includes respective meshing sector gears centered on the respective pivot axes.

6. The strip-bending tool defined in claim 3 wherein the means includes an extensible and retractile actuator pivoted on one of the holders and on the support.

7. An internal tool for bending a strip passing in a strip-travel direction into a tube, the tool comprising:

a support juxtaposable with a face of the passing strip;

at least two roller holders pivotal on the support about respective offset holder pivot axes generally parallel to the strip-travel direction; and respective rollers carried in the holders and rotatable about respective roller axes generally perpendicular to the respective holder axes, the holder pivot axes extending through the rollers generally at the respective roller axes, the rollers including two side rollers symmetrically flanking a central plane substantially parallel to the strip-travel direction and generally bisecting the strip the rollers and a middle roller generally lying on the plane and rotatable about an axis generally perpendicular to the plane.

8. The strip-bending tool defined in claim 7, further comprising means for shifting the middle roller in the plane toward and away from the strip.

9. The strip-bending tool defined in claim 8 wherein the means for shifting includes a threaded nut/bolt assembly engaged between the holder of the middle roller and the support.

10. The strip-bending tool defined in claim 8 wherein the means for shifting includes a removable spacer between the holder of the middle roller and the support.

11. An internal tool for bending a strip passing in a strip-travel direction into a tube, the tool comprising:

a support juxtaposable with a face of the passing strip;

at least two roller holders on the support;

respective side rollers carried in the holders and rotatable thereon about respective roller axes;

means pivotally supporting the holders on the support about respective offset holder pivot axes generally parallel to the strip-travel direction and generally perpendicular to the respective roller axes such that, as the strip passes in the direction in engagement with the side rollers, the side rollers can move angularly freely about the respective holder axes; and a middle roller generally lying on the plane and rotatable about an axis generally perpendicular to the plane.

12. The strip-bending tool defined in claim 11 wherein the holder axes pass through the respective side rollers generally at the respective roller axes.

* * * * *